United States Patent [19]

Merz et al.

[11] 4,423,689

[45] Jan. 3, 1984

[54] METHOD OF PRODUCING PULVERIZED COAL AS FUEL FOR PULVERIZED-COAL PILOT BURNERS

[75] Inventors: Johannes Merz; Gunter v. d. Kammer; Ulrich Rau, all of Gummersbach, Fed. Rep. of Germany

[73] Assignee: L. & C. Steinmüller GmbH, Gummersbach, Fed. Rep. of Germany

[21] Appl. No.: 361,527

[22] Filed: Mar. 23, 1982

[30] Foreign Application Priority Data

Mar. 25, 1981 [DE] Fed. Rep. of Germany ..... 3111674

[51] Int. Cl.[3] ..... F23D 1/00; F23K 5/00

[52] U.S. Cl. ..... 110/347; 16/224; 16/264

[58] Field of Search ..... 110/218, 224, 265, 347

[56] References Cited

U.S. PATENT DOCUMENTS

| | | | |
|---|---|---|---|
| 2,148,447 | 2/1939 | Dundas et al. | 110/224 |
| 4,090,455 | 5/1978 | McCartrey | 110/302 |
| 4,206,712 | 6/1980 | Vatsky | 110/264 |
| 4,246,853 | 1/1981 | Mehta | 110/347 |
| 4,294,178 | 10/1981 | Bono et al. | 110/347 |
| 4,306,507 | 12/1981 | Metz | 110/347 |

*Primary Examiner*—Henry C. Yuen

*Attorney, Agent, or Firm*—Becker & Becker, Inc.

[57] ABSTRACT

A method of producing pulverized coal as fuel for pulverized-coal pilot burners of pulverized-coal annular burners or of systems thereof in a power plant having auxiliary steam generators. The raw coal undergoes or is subjected to a pulverizing-drying, and the pulverized coal which is produced is separated off in a separating system and is supplied either directly or after temporary storage by means of a suitable transporting system to the pilot burners. The thermal drying energy for the pulverizing system is taken from the flue gases of the auxiliary steam generator. The foregoing method can also be utilized for pulverized-coal burners or systems thereof.

1 Claim, 1 Drawing Figure

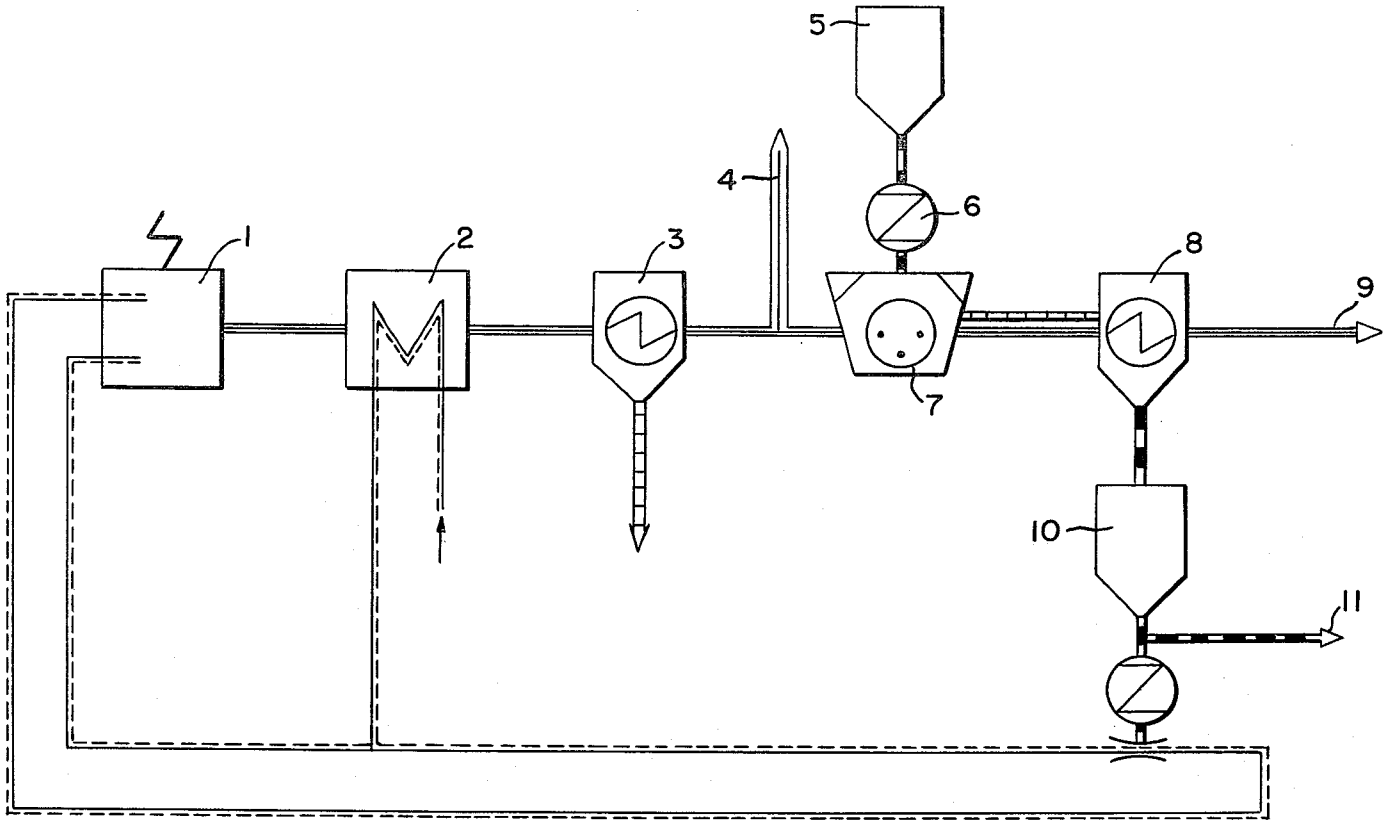
1
2
3
4
5
6
7
8
9
10
11

METHOD OF PRODUCING PULVERIZED COAL AS FUEL FOR PULVERIZED-COAL PILOT BURNERS

The present invention relates to a method of producing pulverized coal or coal dust as a fuel for pulverized-coal ignition or pilot burners of pulverized-coal annular burners or of systems thereof in a power plant having auxiliary steam generators; the raw coal undergoes or is subjected to a pulverizing-drying process, and the pulverized coal which is produced is separated off in a separating system and is supplied either directly or after temporary storage to the pilot burners by means of a suitable transporting system.

An ignition device in the form of a pulverized-coal pilot burner arranged concentrically in the core-air tube is provided for a burner which is intended for combustion of pulverized or finely divided fuels and which comprises a core-air tube with a centrally arranged ignition device, a powder-laden-air tube surrounding the core-air tube, a mantle-air tube surrounding the powder-laden-air tube and having an axially shiftable twist blade ring arranged at the air inlet, as well as a burner mouth or opening expanding conically toward the combustion chamber. For such a pulverized-coal pilot burner it is necessary, in view of the necessity of having an ignitable and stable fuel, to strive not only for pulverized coal having these properties, but also for a very economical production. With power plant-firing systems which use pulverized-coal burners, it is known to have connected thereto a system for preparing the pulverized coal. The raw coal undergoes or is subjected to a pulverizing-drying process. With direct firing, the thermal drying energy for the pulverizing system is made available in a known manner through air preheated in the main system after the first starting period. The pulverized coal for the main burner has a granular spectrum which is not suitable for the pilot burner.

The preparation of the pulverized coal for the pulverized-coal pilot burner, which coal must be finer than that for the main burner system, is carried out in two ways in a known manner. One way is to take the pulverized coal from the main pulverizing system via a suction device. This has the disadvantage that as a result the control of the main firing is affected. Also, a costly and complex suctioning system is necessary, since the suctioning speed has to be matched to the load condition.

The second way of preparing the pulverized coal for the pilot burner is the installation of a central pulverizing system. For this purpose, two methods are known to make available the thermal drying energy, namely:

(a) employing preheated air; and (b) employing of flue gases from the main system.

For situation (a), it is necessary to undertake the utilization of the drying air with an externally heated heat exchanger or a burner system. Both require significant capital investment. The utilization of the burner system additionally means that especially expensive and scarce, high-grade fuels, such as gas or heating oil, must be used.

For situation (b), it is necessary to convey the flue gas of the main system in a heat-insulated channel system to the central pulverizing system. Normally, this means greater distances have to be covered, which leads to a corresponding increase in capital investment. Since the flue gas temperature of the main system, for efficiency reasons, is so designed that a safe difference exists relative to the acid dew point, it is necessary that the pulverizing system be engaged with great flue gas volume flows in order to maintain only small cooling-off intervals in the pulverizing system. This requires a corresponding dimensioning of the channel and pulverizing systems, and of the blowers. Additionally, there must be taken into account the danger of falling below the acid dew point in the pulverizing system. This can lead to an influencing of the pulverizing procedure, and can lead to a concentration of sulphur in the pulverized coal. If the pulverized coal is produced for the pulverized-coal pilot burner of the main system by means of the described central pulverizing system, then, because of the mutual dependence for the situation (b), there exists the problem of preparing the pulverized coal for the first starting of the main system.

It is an object of the present invention to develop a pulverizing system for producing pulverized coal as fuel for pulverized-coal pilot burners, by means of which system pulverized coal can be prepared, and with which the thermal drying energy is obtained in an economically feasible manner.

This object, and other objects and advantages of the present invention, will appear more clearly from the following specification in connection with the accompanying drawing, in which:

The drawing is a schematic diagram illustrating features of a system to carry out a method of producing pulverized coal as a fuel for pulverized coal pilot burners.

The method of the present invention is characterized primarily in that the thermal drying energy for such a pulverizing system is taken from the flue gases of the auxiliary steam generator.

The teaching of the present invention also encompasses the general utilization of the method for pulverized-coal burners or systems thereof.

Referring now to the drawing in detail, to produce pulverized coal or coal dust for the pulverized-coal burner, raw coal is supplied from a bin or bunker 5 via a feeder device 6 to the pulverizing/separating system 7 where it is pulverized. To dry the raw coal in the pulverizer, the flue gas quantity necessary therefor is taken from the flue gas passage of the auxiliary steam generator 1 before the chimney or flue intake 4. Since in the example given, a pulverized-coal-fired auxiliary steam generator is provided, the flue gases of the auxiliary steam generator, before entry into the pulverizing system, must flow through an air preheater 2 to preheat the combustion air for the burners of the auxiliary steam generator, and through an ash-filtering system 3 to separate off the fly ash or flue dust. The pulverized coal which with the carrier medium (flue gas) leaves the pulverizing/separating system 7, is separated off in the pulverized-coal filtering system 8 and is stored in the pulverized-coal bunker or pin 10. The flue gas from the pulverized-coal filter is supplied to the flue or chimney 9. The pulverized-coal burners of the various consumers are supplied from the pulverized-coal bunker 10 with the aid of a suitable transporting system 11. In the illustrated example, the pulverized-coal burners of the auxiliary steam generator also receive the necessary pulverized coal from the bunker 10.

The advantages which are achieved with the present invention consist therein that, since the auxiliary system is operated at high flue gas temperatures, the necessary thermal drying energy can be made available with considerably smaller flue gas volume flow, since a correspondingly great cooling-off interval can be utilized. The efficiency of the auxiliary system, combined with the pulverizing system, is improved in conformity with the additional flue gas cooling-off. The danger of falling below the dew point does not exist. Since the auxiliary steam generator is an independent system, the first pulverized coal for the pulverized-coal pilot burner of the main steam generator can also be produced without difficulty. Since the pulverizing system can be installed in the vicinity of the auxiliary system, short channel lengths result. Consequently, the internal consumption of the blower for the drying medium is reduced therewith and with the smaller flue gas flow. Furthermore, by equpping the auxiliary steam generator with an indirect pulverized coal firing, the conventional high-grade fuel firing in the auxiliary system, using oil or gas, can be replaced by coal with little increased capital investment.

The present invention is, of course, in no way restricted to the specific disclosure of the specification and drawing, but also encompasses any modifications within the scope of the appended claims.

What we claim is:

1. A method of providing pulverized coal for use as fuel for pulverized coal pilot burners in a power plant having main furnaces and at least one auxiliary steam generator which also utilizes pulverized coal, the method comprising the following steps in combination:

storing raw coal in a bunker;

pulverizing the raw coal to produce finely divided fuel particles particularly suitable for burning in pilot burners;

filtering ash from the flue gases of the auxiliary steam generator;

mixing the flue gases with intake air;

entraining the finely divided fuel particles in the mixture of flue gases while the temperature of the mixture is still substantially higher than the acid dew point of the flue gas to both convey the finely divided fuel from the pulverizer and to dry the finely divided fuel particles;

filtering the finely divided fuel from the mixture of flue gas and air to provide a mass of dry finely divided fuel particles;

exhausting the mixture flue gas and air;

storing the finely divided fuel particles in a storage bunker;

distributing the stored, finely divided fuel particles to the pulverized coal pilot burners of the main furnaces as needed, and entraining a portion of the finely divided fuel particles in a stream of air, preheated by the flue gases of the auxiliary generator, and firing the auxiliary generator with the finely divided fuel particles.

* * * * *